US012209814B2

(12) United States Patent
Kikuchi et al.

(10) Patent No.: US 12,209,814 B2
(45) Date of Patent: Jan. 28, 2025

(54) HEAT EXCHANGER HAVING A SWIRLING COMPONENT

(71) Applicant: DENSO CORPORATION, Kariya (JP)

(72) Inventors: Kengo Kikuchi, Kariya (JP); Kenshiro Muramatsu, Kariya (JP); Yusuke Takagi, Kariya (JP); Satoshi Nita, Kariya (JP)

(73) Assignee: DENSO CORPORATION, Kariya (JP)

( * ) Notice: Subject to any disclaimer, the term of this patent is extended or adjusted under 35 U.S.C. 154(b) by 351 days.

(21) Appl. No.: 17/592,624

(22) Filed: Feb. 4, 2022

(65) Prior Publication Data

US 2022/0155021 A1 May 19, 2022

Related U.S. Application Data

(63) Continuation of application No. PCT/JP2020/030398, filed on Aug. 7, 2020.

(30) Foreign Application Priority Data

Aug. 8, 2019 (JP) ..... 2019-146403
Aug. 7, 2020 (JP) ..... 2020-134484

(51) Int. Cl.
*F28D 9/02* (2006.01)
*F28F 1/40* (2006.01)
(Continued)

(52) U.S. Cl.
CPC ..... *F28D 9/02* (2013.01); *F28F 1/40* (2013.01); *F28F 9/22* (2013.01); *F28F 9/0265* (2013.01);
(Continued)

(58) Field of Classification Search
CPC ..... F28F 9/0268; F28F 9/0265; F28F 9/0282; F28F 13/12; F28F 13/125; F28F 9/22; F28D 9/02
See application file for complete search history.

(56) References Cited

U.S. PATENT DOCUMENTS 4,524,823 A * 6/1985 Hummel ..... F28F 9/028 165/174
4,545,426 A * 10/1985 Collins ..... B08B 9/053 15/3.52
(Continued)

FOREIGN PATENT DOCUMENTS

FR 3066263 A1 * 11/2018
GB 2056648 A * 3/1981 ..... F28D 9/0043
(Continued)

*Primary Examiner* — Paul Alvare
(74) *Attorney, Agent, or Firm* — Harness, Dickey & Pierce, P.L.C.

(57) ABSTRACT

A heat exchanger is formed by stacking plates with each other. The heat exchanger includes a refrigerant receiving tank configured to receive a refrigerant, a refrigerant discharging tank configured to discharge the refrigerant that has heat-exchanged, and refrigerant passages in which heat exchange between the refrigerant and another fluid is performed. The refrigerant passages fluidly connect between the refrigerant receiving tank and the refrigerant discharging tank. The refrigerant receiving tank includes a swirl structure configured to generate a swirling component in a flow of the refrigerant in the refrigerant receiving tank.

7 Claims, 17 Drawing Sheets

(51) Int. Cl.
*F28F 9/22* (2006.01)
*F28F 13/12* (2006.01)
*F28F 9/02* (2006.01)

(52) U.S. Cl.
CPC ..... *F28F 9/0268* (2013.01); *F28F 9/0282* (2013.01); *F28F 13/12* (2013.01); *F28F 13/125* (2013.01)

(56) References Cited

U.S. PATENT DOCUMENTS 4,593,539 A * 6/1986 Humpolik ..... F25B 41/45 62/504
6,179,051 B1 * 1/2001 Ayub ..... F28D 9/005 137/561 A
6,227,290 B1 * 5/2001 Nishishita ..... F28F 9/027 62/515
2005/0284620 A1 * 12/2005 Thunwall ..... F28F 3/04 165/167
2006/0174611 A1 * 8/2006 Dilley ..... F02M 26/26 60/320
2016/0084548 A1 * 3/2016 Ota ..... F28D 1/05391 62/526
2018/0106561 A1 * 4/2018 Diffey ..... F28F 9/028

FOREIGN PATENT DOCUMENTS

JP S63-220054 A 9/1988
JP H11-287573 A 10/1999
JP 2001050611 A * 2/2001 ..... F25B 39/022
JP 2001082883 A 3/2001
JP 2007051804 A * 3/2007 ..... F28D 1/0325
JP 2011-231972 A 11/2011
WO WO-2014068687 A1 * 5/2014 ..... F25B 39/028
WO WO-2020134907 A1 * 7/2020 ..... F28D 9/005

* cited by examiner

HEAT EXCHANGER HAVING A SWIRLING COMPONENT

CROSS REFERENCE TO RELATED APPLICATIONS

The present application is a continuation application of International Patent Application No. PCT/JP2020/030398 filed on Aug. 7, 2020, which designated the U.S. and claims the benefit of priority from Japanese Patent Application No. 2019-146403 filed on Aug. 8, 2019, and Japanese Patent Application No. 2020-134484 filed on Aug. 7, 2020. The entire disclosures of all of the above applications are incorporated herein by reference.

TECHNICAL FIELD

The present disclosure relates to a heat exchanger.

BACKGROUND ART

A heat exchanger including a tank portion for distributing and collecting a refrigerant and refrigerant passages through which the refrigerant from the tank portion flows has been known.

SUMMARY

A heat exchanger includes a refrigerant receiving tank configured to receive a refrigerant, a refrigerant discharging tank configured to discharge the refrigerant that has heat-exchanged, and a plurality of refrigerant passages in which heat exchange between the refrigerant and another fluid is performed. The plurality of refrigerant passages fluidly connect between the refrigerant receiving tank and the refrigerant discharging tank. The refrigerant receiving tank includes a swirl structure configured to generate a swirling component in a flow of the refrigerant in the refrigerant receiving tank. The heat exchanger is formed by staking a plurality of plates with each other.

DESCRIPTION OF EMBODIMENTS

Figure 1:
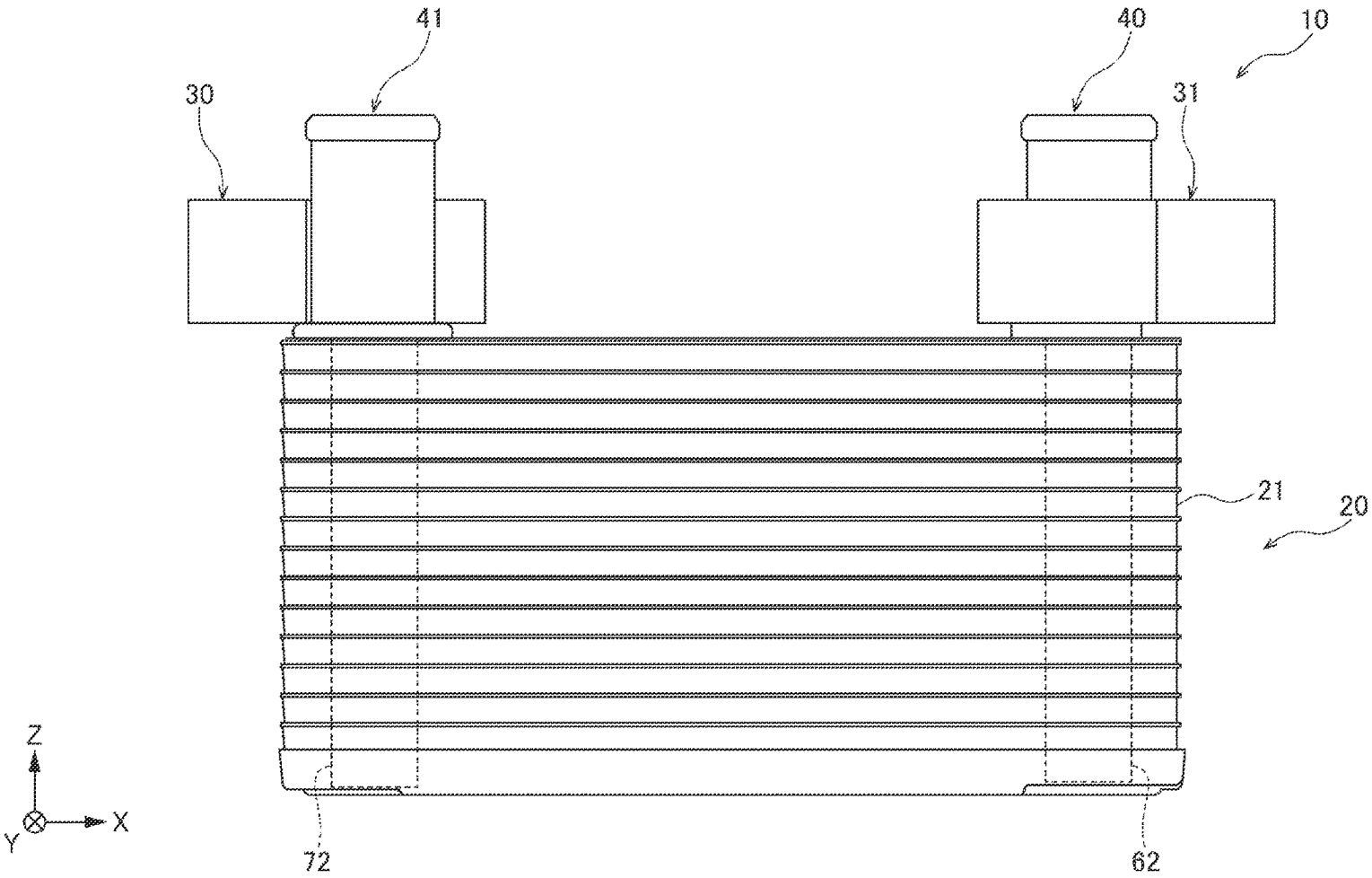
FIG. 1 is a front view of a heat exchanger according to the present embodiment.

To begin with, examples of relevant techniques will be described.

A heat exchanger including a tank portion for distributing and collecting a refrigerant and refrigerant passages through which the refrigerant from the tank portion flows has been known.

It is ideal that the refrigerant flowing into the tank portion is evenly distributed to each of the refrigerant passages. However, there are variations in the distribution due to the influence of the inertial force of the refrigerant.

It is an objective of the present disclosure to provide a heat exchanger that can distribute the refrigerant more evenly.

The present disclosure relates to a heat exchanger. The heat exchanger includes a refrigerant receiving tank configured to receive a refrigerant, a refrigerant discharging tank configured to discharge the refrigerant that has heat-exchanged, and a plurality of refrigerant passages in which heat exchange between the refrigerant and another fluid is performed. The plurality of refrigerant passages fluidly connect between the refrigerant receiving tank and the refrigerant discharging tank. The refrigerant receiving tank includes a swirl structure configured to generate a swirling component in a flow of the refrigerant in the refrigerant receiving tank. The heat exchanger is formed by staking a plurality of plates with each other.

Since the swirl structure generates a swirling component in the flow of the refrigerant in the refrigerant receiving tank, the refrigerant can be dispersed in a circumferential direction along a wall of the refrigerant receiving tank. The heat exchanger has a stacking structure of the plurality of plates. Thus, it is possible to easily adjust, according to the swirling component, a width of an inlet of each of the refrigerant passages and a distance between adjacent ones of the refrigerant passages. Therefore, the refrigerant is inhibited from flowing mainly into the inlet near the swirl structure, dispersed in an extending direction of the refrigerant receiving tank, and distributed into the inlets of the refrigerant passages.

Hereinafter, the present embodiments will be described with reference to the attached drawings. In order to facilitate the understanding, the same reference numerals are attached to the same constituent elements in each drawing where possible, and redundant explanations are omitted.

A heat exchanger 10 according to the present embodiment shown in FIG. 1 will be described. The heat exchanger 10 can be used as an evaporator that evaporates a refrigerant circulating through a refrigerant cycle in an air-conditioner mounted in a vehicle by exchanging heat between the refrigerant and a cooling water. In this embodiment, the cooling water corresponds to a fluid that exchanges heat with the refrigerant. The heat exchanger 10 is not limited to the evaporator, and can be used as, for example, a water-cooled condenser.

As shown in FIG. 1, the heat exchanger 10 includes a heat exchange core 20, a refrigerant inflow portion 30, a refrigerant outflow portion 31, a cooling water inflow portion 40, and a cooling water outflow portion 41.

The heat exchange core 20 is formed by stacking multiple plate members 21 with each other in a Z-axis direction. Hereinafter, the Z-axis direction is also referred to as "a plate stacking direction Z". The plate members 21 define, therein, refrigerant passages through which the refrigerant flows and cooling water passages through which the cooling water flows. The refrigerant passages and the cooling water passages are alternately arranged in the heat exchanger 10.

Figure 2:
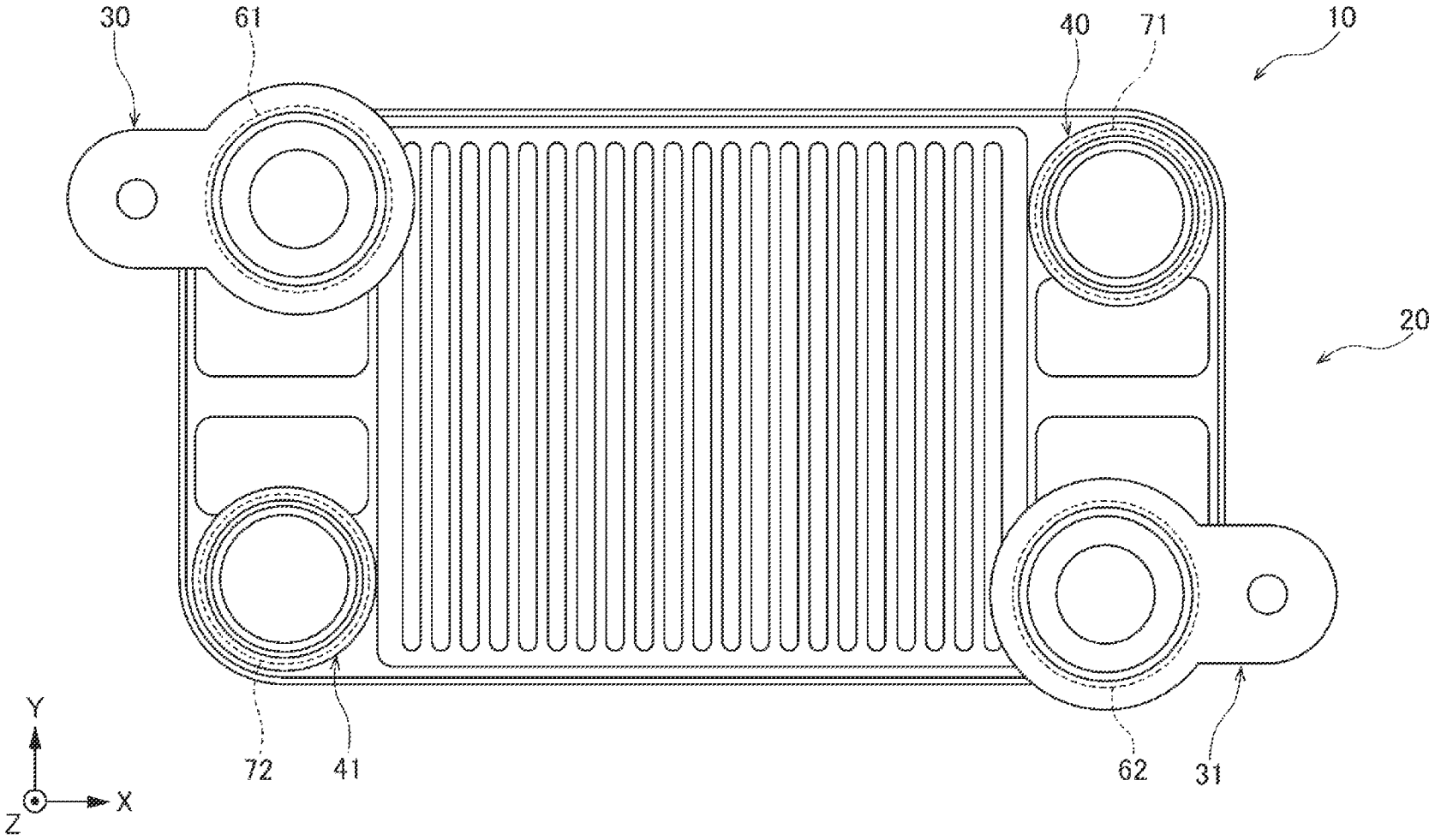
FIG. 2 is a plan view of the heat exchanger according to the present embodiment.

As shown in FIG. 2, a cross-section of the heat exchange core 20 perpendicular to the plate stacking direction Z has a substantially rectangular shape. Hereinafter, the longitudinal direction and the lateral direction of the heat exchange core 20 are referred to as "an X-axis direction" and "a Y-axis direction", respectively.

The outermost plate member 21 in the Z-axis direction of the plate members 21 includes the refrigerant inflow portion 30 and the refrigerant outflow portion 31. The refrigerant inflow portion 30 and the refrigerant outflow portion 31 are diagonally located at two corners of the four corners of the outermost plate member 21. Further, the cooling water inflow portion 40 and the cooling water outflow portion 41 are diagonally located at the remaining corners of the outermost plate member 21.

As shown in FIGS. 1 and 2, a refrigerant receiving tank 61 and a refrigerant discharging tank 62 are formed in the heat exchange core 20. The refrigerant receiving tank 61 extends from the refrigerant inflow portion 30 in a negative direction of the Z-axis direction. The refrigerant discharging tank 62 extends from the refrigerant outflow portion 31 in the negative direction of the Z-axis direction. The refrigerant receiving tank 61 has a cylindrical shape. The refrigerant discharging tank 62 has a cylindrical shape.

Further, a cooling water receiving tank 71 and a cooling water discharging tank 72 are formed in the heat exchange core 20. The cooling water receiving tank 71 extends from the cooling water inflow portion 40 in the negative direction of the Z-axis direction. The cooling water discharging tank 72 extends from the cooling water outflow portion 41 in the negative direction of the Z-axis direction. The cooling water receiving tank 71 has a cylindrical shape. The cooling water discharging tank 72 has a cylindrical shape. The refrigerant receiving tank 61, the refrigerant discharging tank 62, the cooling water receiving tank 71, and the cooling water discharging tank 72 are formed to pass through the plate members 21 in the plate stacking direction Z.

In the heat exchanger 10, the refrigerant having a two-phase state of a gas phase and a liquid phase flows into the refrigerant receiving tank 61 from the refrigerant inflow portion 30. The refrigerant that has flowed into the refrigerant receiving tank 61 is distributed to the multiple refrigerant passages of the heat exchange core 20. The refrigerant that has flowed through each of the refrigerant passages is collected in the refrigerant discharging tank 62 and then discharged through the refrigerant outflow portion 31.

In the heat exchanger 10, the cooling water flows into the cooling water receiving tank 71 through the cooling water inflow portion 40. The cooling water that has flowed into the cooling water receiving tank 71 is distributed to the cooling water passages of the heat exchange core 20. The cooling water that has flowed through each of the cooling water passages is collected in the cooling water discharging tank 72 and then discharged through the cooling water outflow portion 41. In the heat exchanger 10, the refrigerant is heated and evaporated through heat exchange between the refrigerant flowing through the refrigerant passages and the cooling water flowing through the cooling water passages.

Figure 3:
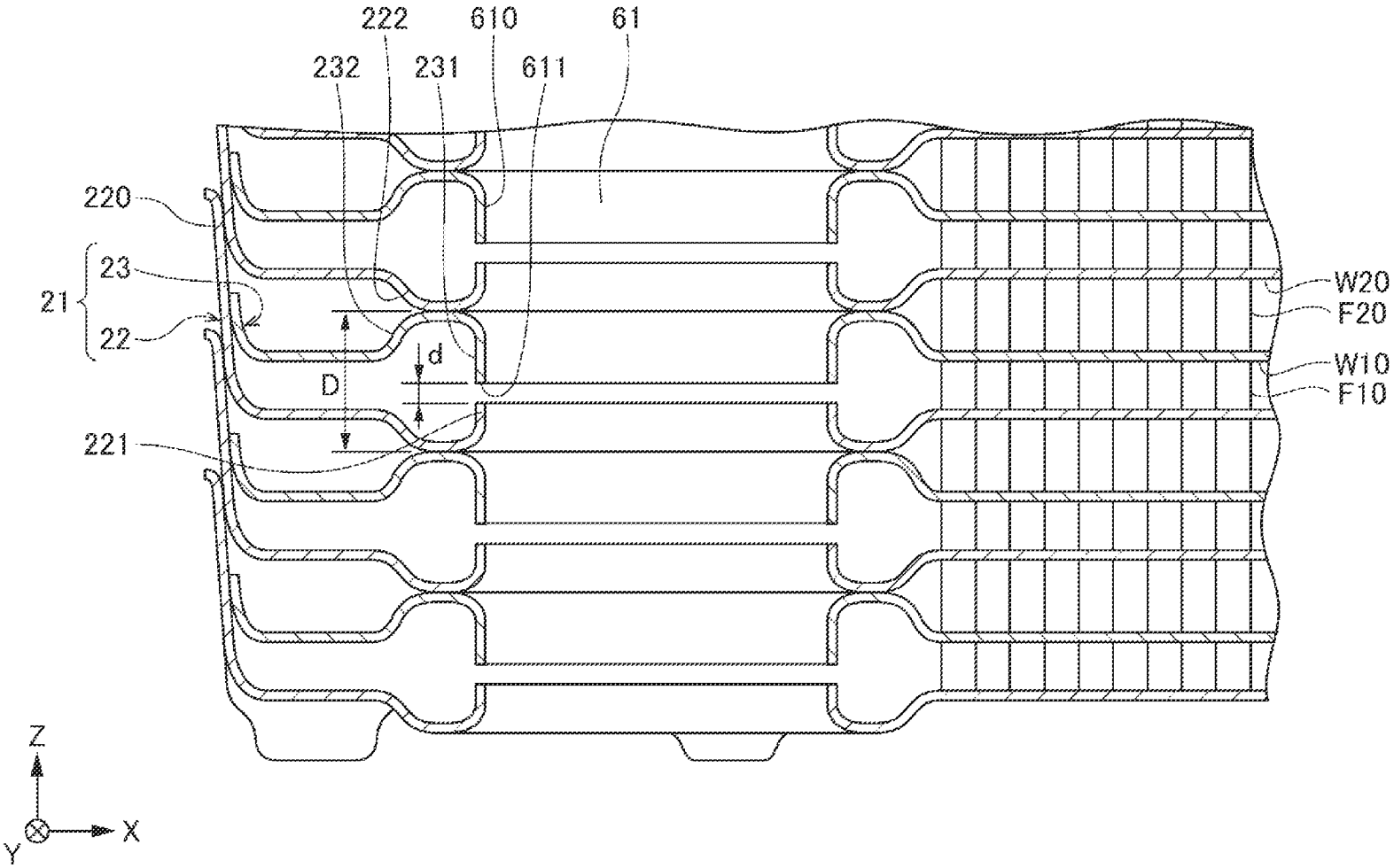
FIG. 3 is a view for explaining a refrigerant distribution structure of the heat exchanger.

As shown in FIG. 3, the heat exchange core 20 includes the plate members 21, refrigerant fins F10, and cooling water fins F20. These members are made of a metal material such as an aluminum alloy.

The plate members 21 include outer plates 22 and inner plates 23.

Each of the outer plates 22 is made of a plate-shaped member. The cross-section of each of the outer plates 22 perpendicular to the plate stacking direction Z has a substantially rectangular shape. Each of the outer plates 22 has an extending portion 220 protruding from an outer peripheral edge of the outer plate 22 in the positive direction of the Z-axis direction. The outer plates 22 are stacked with each other such that the extending portions 220 face in the positive direction of the Z-axis direction. The extending portions 220 of the outer plates 22 are joined to each other by brazing.

Each of the outer plates 22 has a burring portion 221 formed by burring. The burring portion 221 protrudes in the positive direction of the Z-axis direction to have a cylindrical shape about a center axis of the refrigerant receiving tank 61. Each of the outer plates 22 has a protruding portion 222 at a proximal end of the burring portion 221. The protruding portion 222 protrudes from the proximal end in the positive direction of the Z-axis direction.

Similar to the outer plates 22, each of the inner plates 23 is made of a plate-shaped member. The cross-section of the outer plate 22 perpendicular to the plate stacking direction Z has a substantially rectangular shape. Each of the inner plates 23 is arranged inward of the extending portion 220 of the outer plate 22 and is arranged between adjacent ones of the outer plates 22.

Each of the inner plates 23 has an outer peripheral edge joined to an inner surface of the extending portion 220 of the outer plate 22 by brazing. Each of the inner plates 23 divides a space defined between the adjacent ones of the outer plates 22 into the refrigerant passage W10 and the cooling water passage W20 that are not in communication with each other. More specifically, the refrigerant passage W10 is a gap defined between the inner plate 23 and the outer plate 22 that is located on a negative side in the Z-axis direction of the inner plate 23. Further, the cooling water passage W20 is a gap defined between the inner plate 23 and the outer plate 22 that is located on a positive side in the Z-axis direction of the inner plate 23.

The refrigerant fins F10 are arranged respectively in the refrigerant passages W10. Similarly, the cooling water fins F20 are arranged respectively in the cooling water passages W20. As the refrigerant fins F10 and the cooling water fins F20, for example, offset fins can be used. The refrigerant fins F10 increase a heat transfer area for the refrigerant flowing through the refrigerant passages W10. The cooling water fins F20 increase a heat transfer area for the cooling water flowing through the cooling water passages W20.

Each of the inner plates 23 has a burring portion 231 formed by burring. The burring portion 231 of the inner plates 23 is located at a position corresponding to the burring portion 221 of the outer plate 22. The burring portion 231 protrudes in the negative direction of the Z-axis direction to have a cylindrical shape about the center axis of the refrigerant receiving tank 61. Each of the inner plates 23 has a protruding portion 232 at a proximal end of the burring portion 231. The protruding portion 232 protrudes from the proximal end in the negative direction of the Z-axis direction.

The protruding portion 232 of the inner plate 23 and the protruding portion 222 of the outer plate 22 that is adjacent to the inner plate 23 in the positive direction of the Z-axis direction are joined to each other by brazing. As a result, the burring portions 221 of the outer plates 22 and the burring portions 231 of the inner plates 23 form the refrigerant receiving tank 61 defining a cylindrical space therein.

The burring portions 221 of the outer plates 22 and the burring portions 231 of the inner plates 23 form a cylindrical wall 610 of the refrigerant receiving tank 61. Further, the protruding portions 222 of the outer plates 22 and the protruding portions 232 of the inner plates 23 are joined to each other, so that the cooling water passages W20 are separated from the refrigerant receiving tank 61. Therefore, the refrigerant flowing through the refrigerant receiving tank 61 does not flow into the cooling water passages W20.

There is a gap between a distal end of the burring portion 221 of the outer plate 22 and a distal end of the burring portion 231 of the inner plate 23. This gap serves as an inlet 611. The refrigerant flowing into the refrigerant receiving tank 61 is distributed into the refrigerant passages through the inlets 611.

Figure 4:
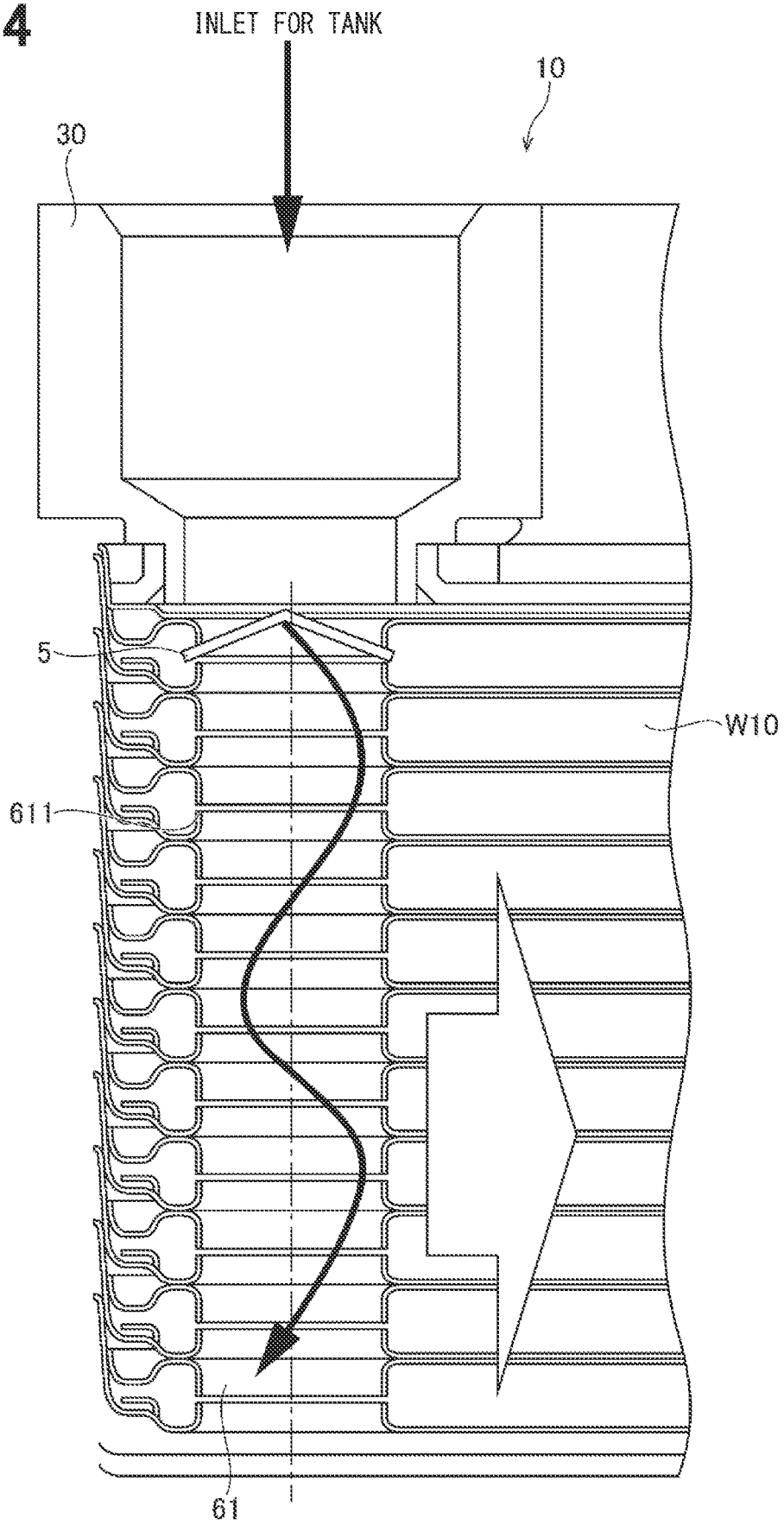
FIG. 4 is a partial cross-sectional view for explaining a mode of refrigerant distribution in the heat exchanger shown in FIGS. 1 and 2.

As shown in FIG. 4, in the present embodiment, a swirl vane 5 is provided as a swirl structure that generates a swirling component in the flow of the refrigerant received in the refrigerant receiving tank 61 in order to improve distributability of the refrigerant in the refrigerant receiving tank 61. The swirl vane 5 is provided near an inlet opening of the refrigerant receiving tank 61.

Figure 5:
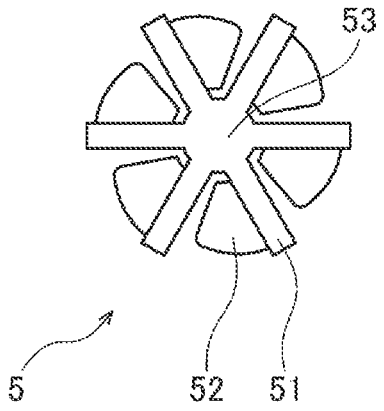
FIG. 5 is a view for explaining a swirl vane.

FIG. 5 is a view of the swirl vane 5 viewed in an inflow direction of the refrigerant in which the refrigerant flows into the refrigerant receiving tank 61. As shown in FIG. 5, the swirl vane 5 includes vane shafts 51, vanes 52, and a main shaft 53. The vane shafts 51 radially extend from the main shaft 53. The vane shafts 51 are radially provided when viewed in the inflow direction of the refrigerant. The vanes 52 are respectively provided at the vane shafts 51.

Figure 6:
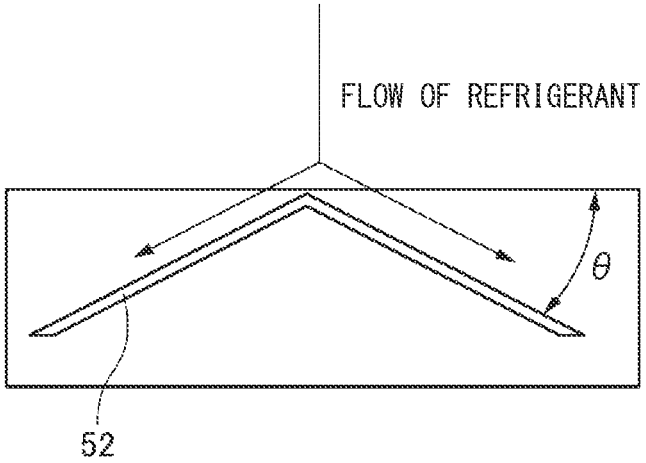
FIG. 6 is a view for explaining refrigerant distribution efficiency of the swirl vane.

As shown in FIG. 6, the vanes 52 of the swirl vane 5 are tilted relative to a horizontal plane by θ in the flow direction of the refrigerant. When D, d, θ, and x are defined as below, in this embodiment, it is preferable to satisfy the following equation (f1).

D: Distance between adjacent ones of the refrigerant passages (see FIG. 3)

d: Width of an inlet of each of the refrigerant passages (see FIG. 3)

θ: Angle of the vane of the swirl vane x: Ratio of an area of the vanes to a cross-sectional area of the refrigerant receiving tank (in FIG. 5, the sum of projected areas of the vane shafts 51 and the vanes 52 is the area of the vanes).

$$0<d\cdot x\cdot\cos\theta/D<0.6 \quad \text{(f1)}$$

More preferably, the following equation (f2) is satisfied.

$$0.02<d\cdot x\cdot\cos\theta/D<0.5 \quad \text{(f2)}$$

Figure 7:
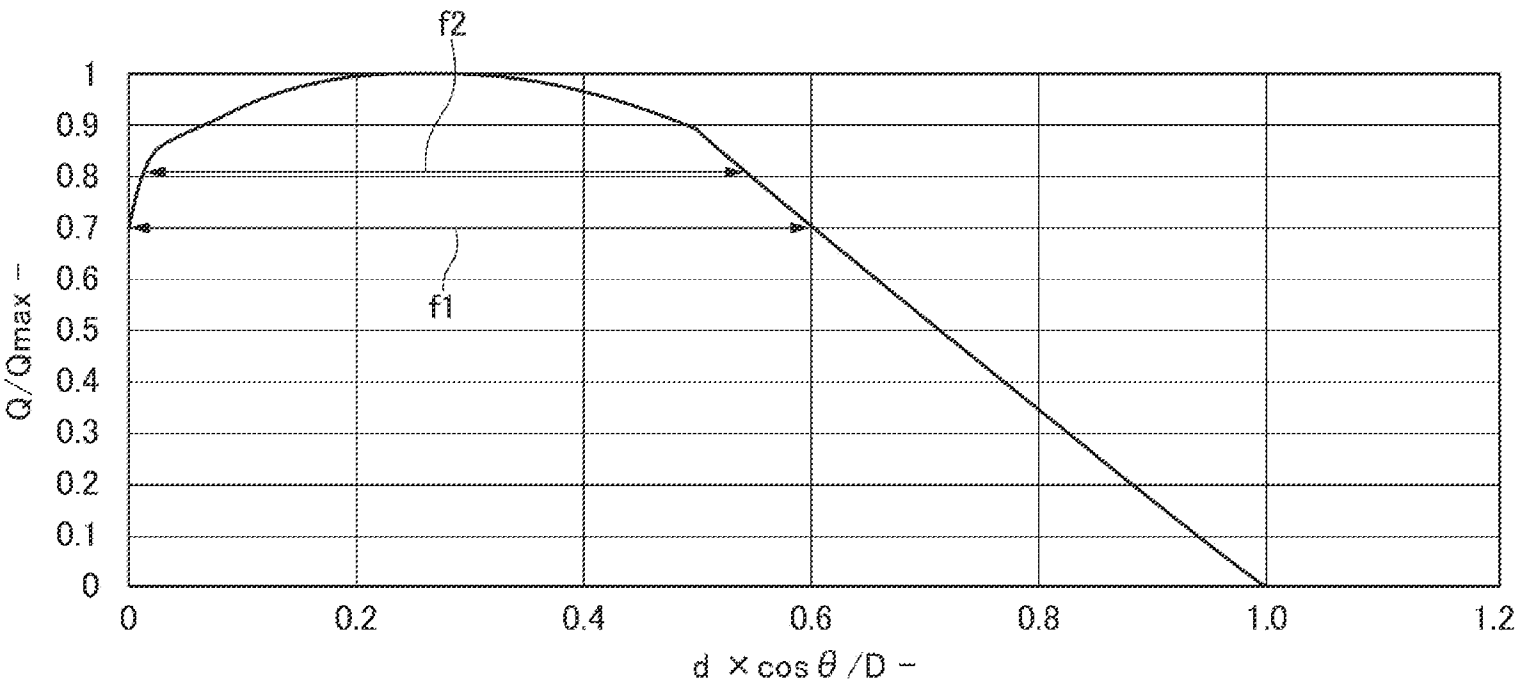
FIG. 7 is a diagram for explaining a relationship between the efficiency of the heat exchanger, swirling force, and an ease with which the refrigerant can flow into passages.

As shown in FIG. 7, from a graph plotted with the performance of the heat exchanger 10 as the vertical axis, and the swirling force and an ease with which the refrigerant flows into stacked passages (d·x·cos θ/D) as the horizontal axis, a range in which a predetermined performance improvement effect is obtained can be specified. When the above equations (f1) and (f2) are satisfied, such performance improvement can be obtained.

Figure 8:
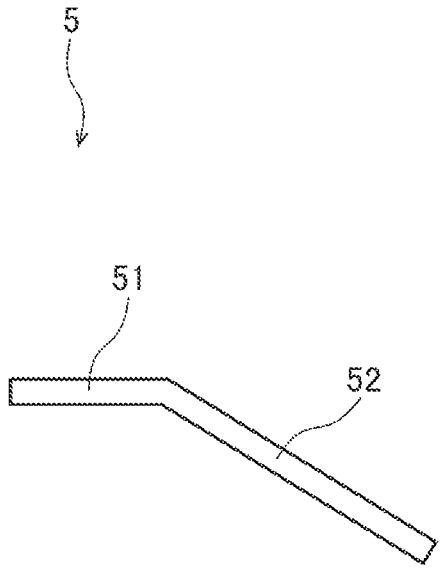
FIG. 8 is a side view of the swirl vane.
Figure 9:
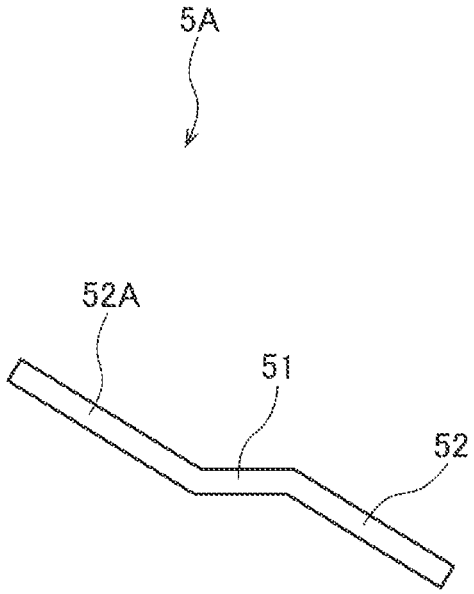
FIG. 9 is a side view of a swirl vane as a modified example.

As shown in FIG. 8, the swirl vane 5 is arranged such that the vanes 52 are tilted downward from the vane shafts 51. The swirl vane 5 may be a swirl vane 5A as shown in FIG. 9. The swirl vane 5A has vanes 52A tilted upward from the vane shafts 51 in addition to the vanes 52 tilted downward from the vane shafts 51.

Figure 10:
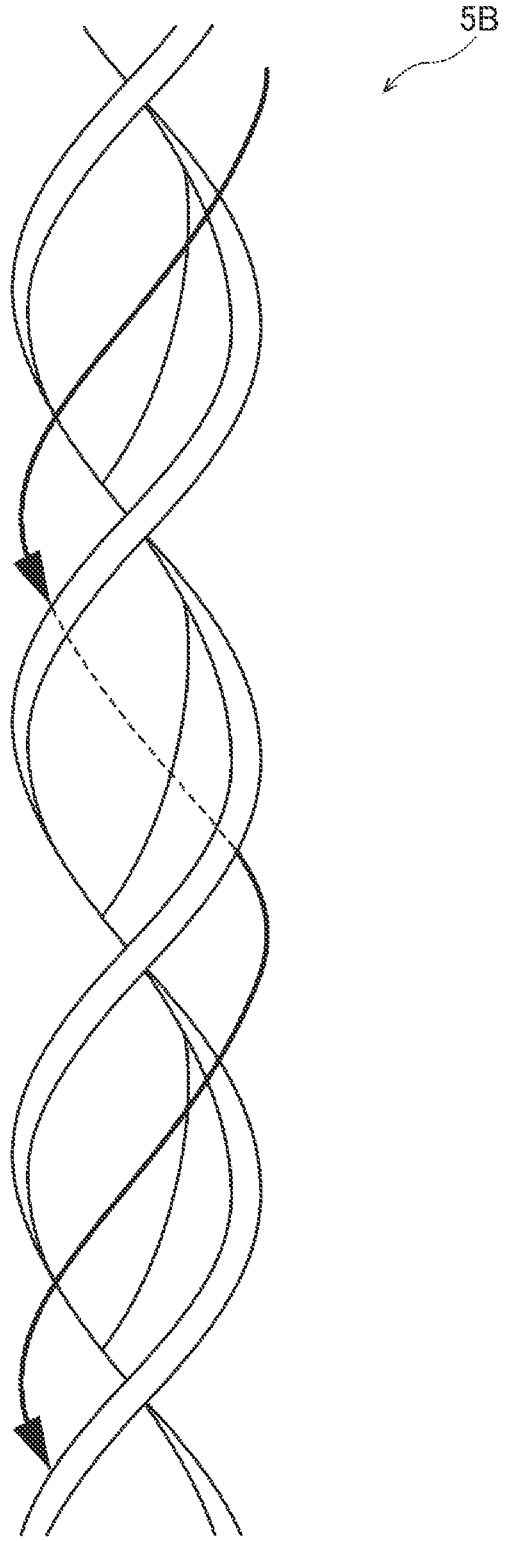
FIG. 10 is a view for explaining a swirl member.

The swirl vane 5 generates a swirling component in the flow of the refrigerant flowing into the refrigerant receiving tank 61. As a swirl structure that generates a swirling component in the flow of the refrigerant flowing into the refrigerant receiving tank 61, a spiral swirl member 5B as shown in FIG. 10 may be used. The refrigerant flowing along the spiral swirl member 5B has a swirling component.

Figure 11:
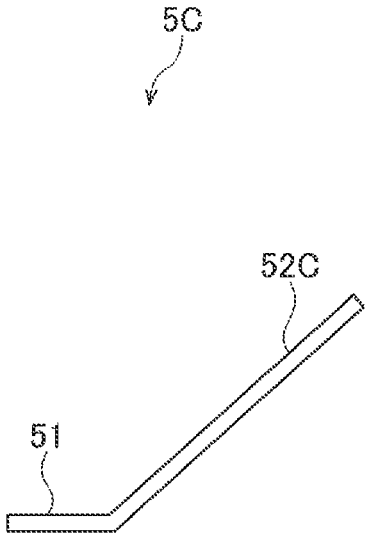
FIG. 11 is a side view of a swirl vane as a modified example.
Figure 12:
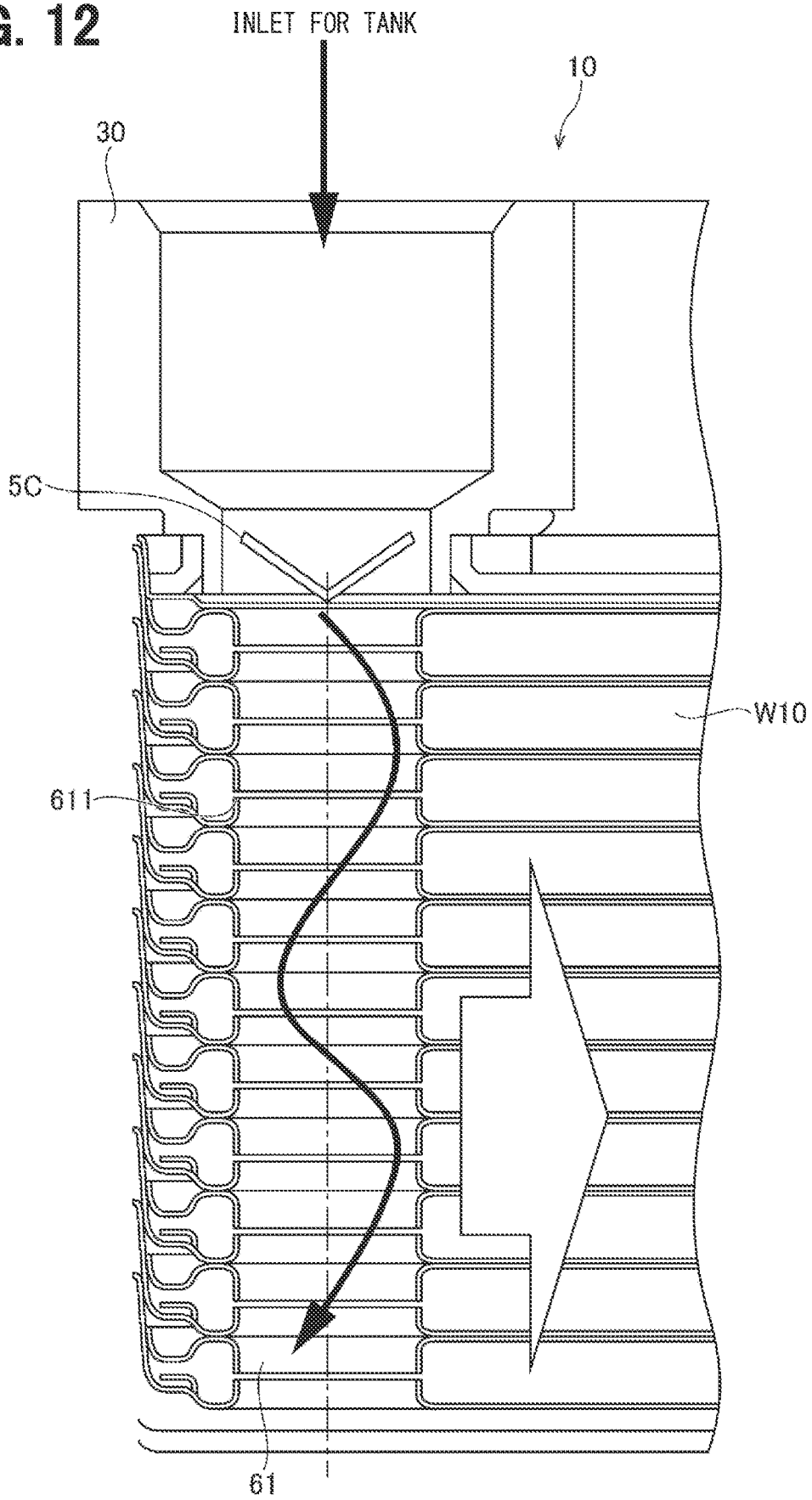
FIG. 12 is a partial cross-sectional view for explaining a mode of refrigerant distribution in a heat exchanger when the swirl vane shown in FIG. 11 is used.

As shown in FIG. 11, a swirl vane 5C has vanes 52C tilted upward from the vane shafts 51. As shown in FIG. 12, even when the swirl vane 5C is used, the swirl vane 5C also serves as the swirl structure that generates a swirling component in the flow of the refrigerant and can enhance the distributability of the refrigerant in the refrigerant receiving tank 61.

Figure 13:
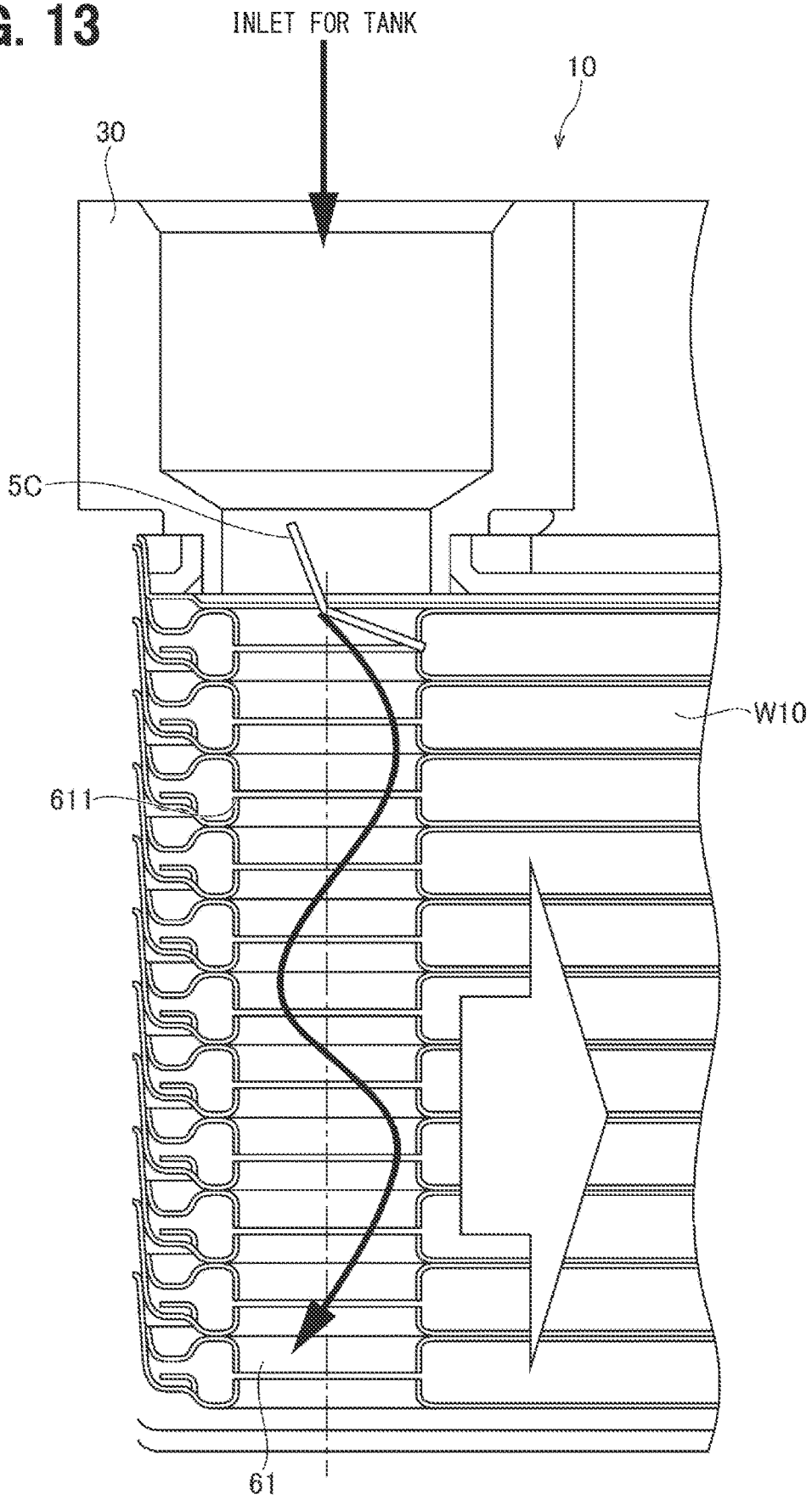
FIG. 13 is a partial cross-sectional view for explaining a modification of FIG. 12.
Figure 14:
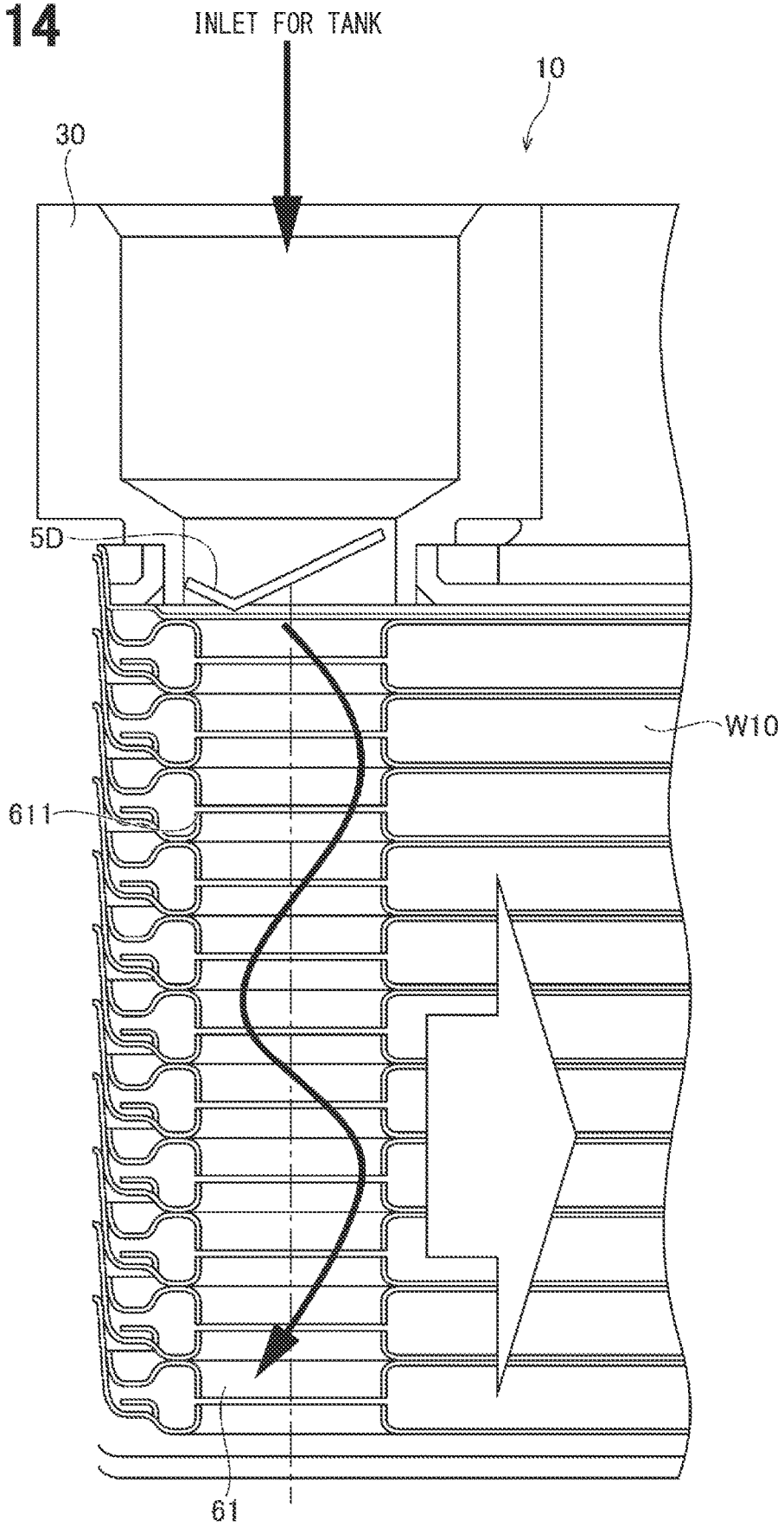
FIG. 14 is a partial cross-sectional view for explaining a modification of FIG. 12.

As shown in FIG. 13, even when the swirl vane 5C is arranged in a tilted manner, the distributability of the refrigerant can be improved. As shown in FIG. 14, even when a swirling vane 5D having vanes that are asymmetrically provided is used, the distributability of the refrigerant can be improved.

Figure 15:
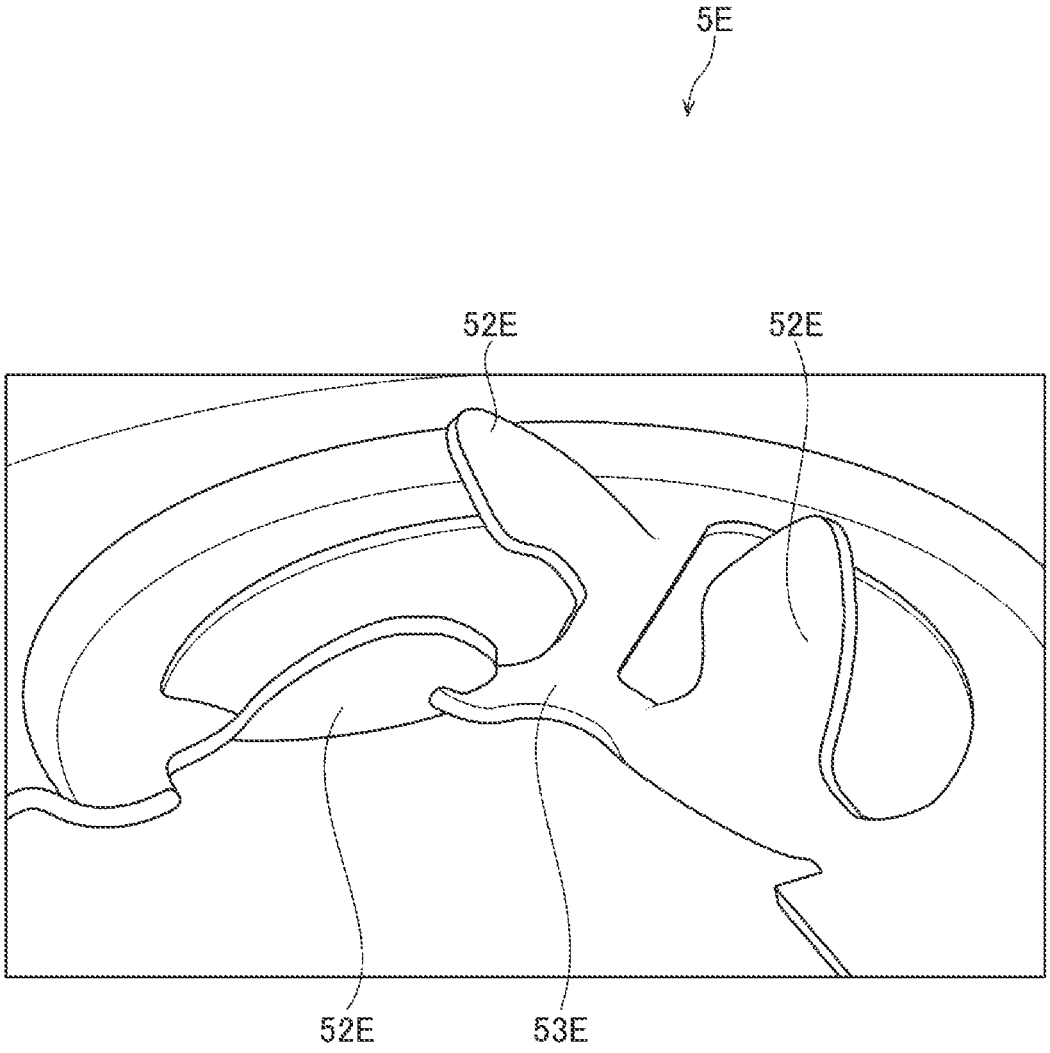
FIG. 15 is a perspective view of a swirl vane as a modified example.

With reference to FIG. 15, a swirl vane 5E without a vane shaft will be described. The swirl vane 5E includes a main shaft 53E and vanes 52E connected to the main shaft 53E. The vanes 52E are formed by cutting and twisting a part of a plate member provided on the same plane with the main shaft 53E.

Figure 16:
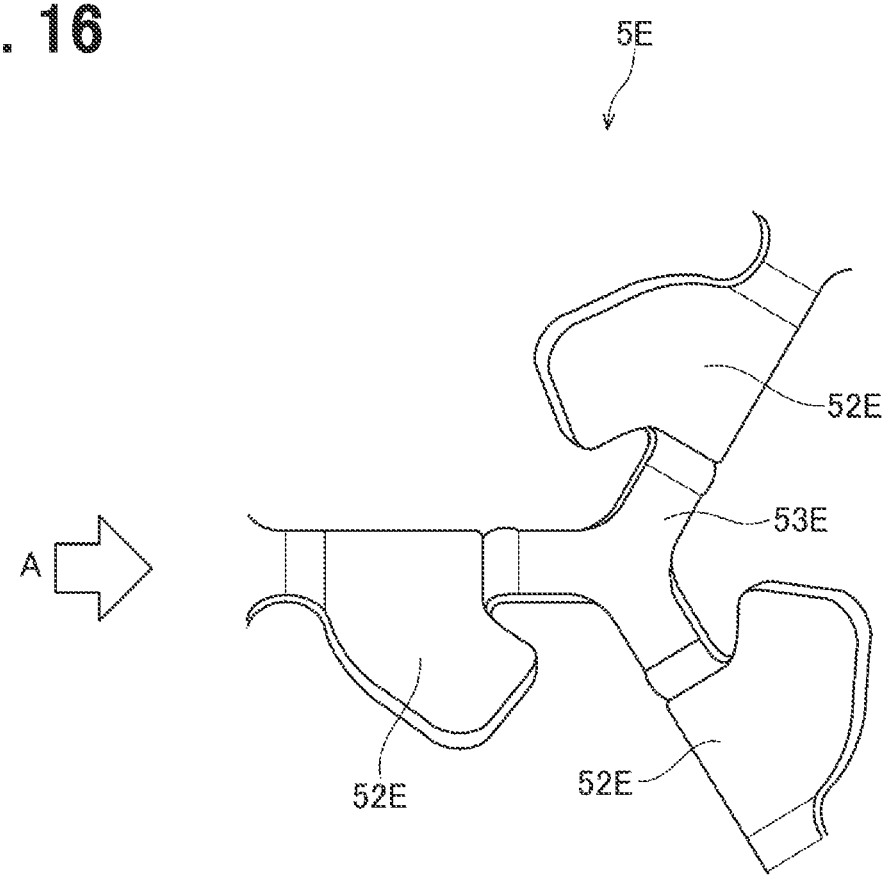
FIG. 16 is a plan view of the swirl vane shown in FIG. 15.
Figure 17:
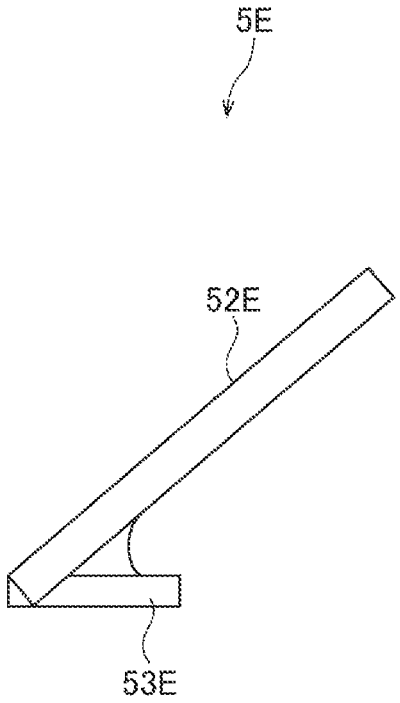
FIG. 17 is a side view as viewed from an A direction in FIG. 16.

As shown in FIG. 16, the swirl vane 5E as the swirl structure has the main shaft 53E and the vanes 52E connected to the main shaft 53E, and the vanes 52E are tilted at a constant angle relative to the main shaft 53E between one end and the other end of the vanes 52E. In order to clarify this tilted state, the swirl vane 5E viewed in an A direction is shown in FIG. 17. As shown in FIG. 17, each of the vanes 52E has no bent portion and extends straight between one end and the other end.

Figure 18:
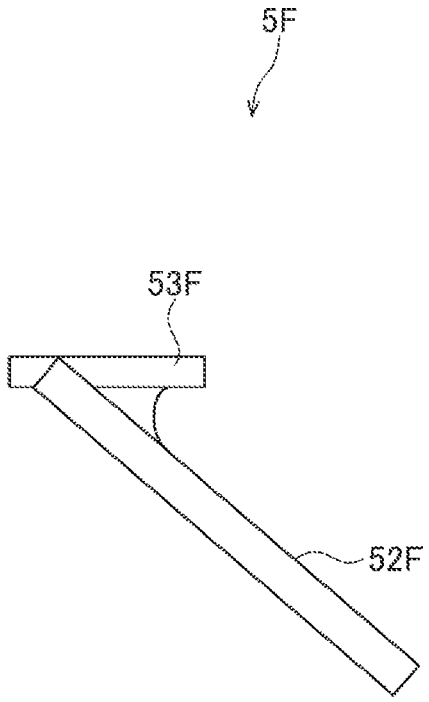
FIG. 18 is a side view of a modified example of the swirl vane shown in FIG. 17.
Figure 19:
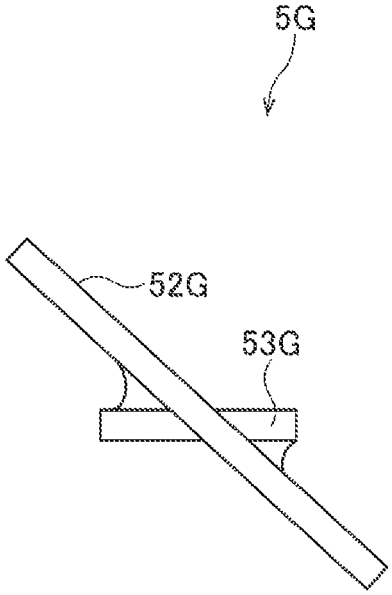
FIG. 19 is a side view of a modified example of the swirl vane shown in FIG. 17.

Directions in which the vanes 52E are tilted with respect to the main shaft 53E and arrangements of the vanes 52E can be variously changed. As shown in FIG. 18, a swirl vane 5F has vanes 52F tilted downward from the main shaft 53F. As shown in FIG. 19, a swirl vane 5G has vanes 52G tilted from an upside to a downside of the main shaft 53G.

The refrigerant receiving tank 61 and the refrigerant passages W10 described above are examples and various other modes can be adopted.

Figure 20:
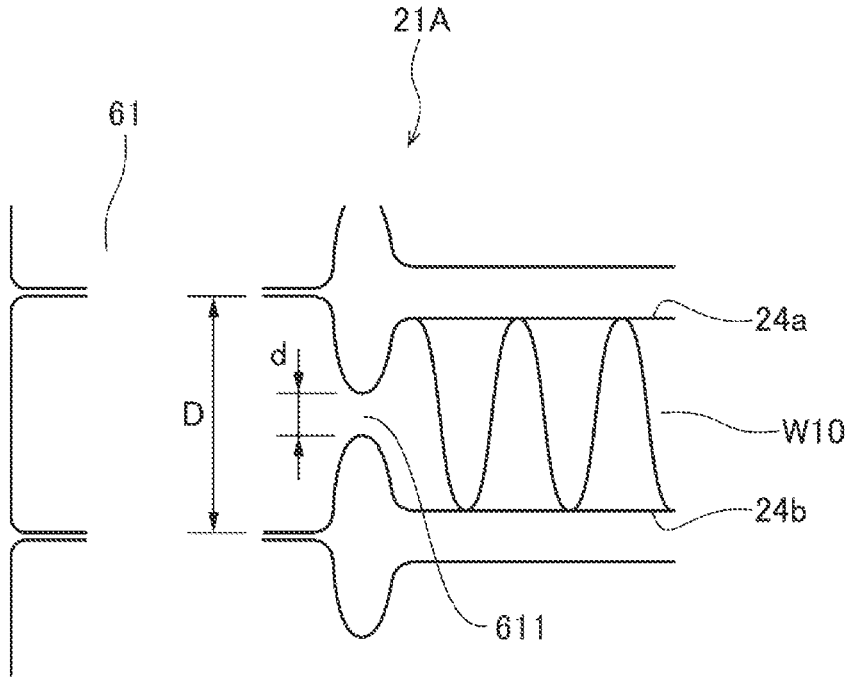
FIG. 20 is a view for explaining a refrigerant distribution structure as a modification.

In a heat exchange core 21A shown in FIG. 20, the refrigerant receiving tank 61 and the refrigerant passages W10 are defined by vertically symmetrical plates 24*a* and 24*b*. Each of the plate 24*a* and the plate 24*b* has a protrusion facing each other. A gap between the protrusions serves as the inlet 611.

Figure 21:
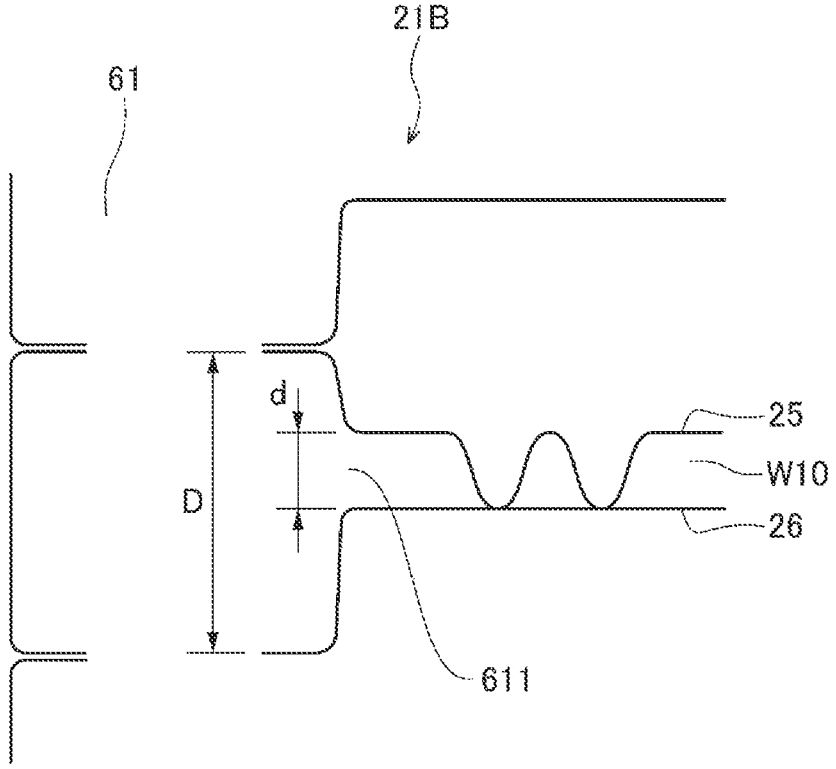
FIG. 21 is a view for explaining a refrigerant distribution structure as a modification.

In a heat exchange core 21B shown in FIG. 21, the refrigerant receiving tank 61 and the refrigerant passages W10 are defined by a combination of plates 25 provided with ribs instead of the refrigerant fins F10 and plates 26 without ribs. Each of the plates 25 has a step portion near an edge of each of the plates 25. Each of the plates 26 has a step portion near an edge of each of the plates 26. A distance between the plate 25 and the plate 25 is expanded at the step portions toward the edges. The inlet 611 is defined between the step portion of the plate 25 and the step portion of the plate 26.

Figure 22:
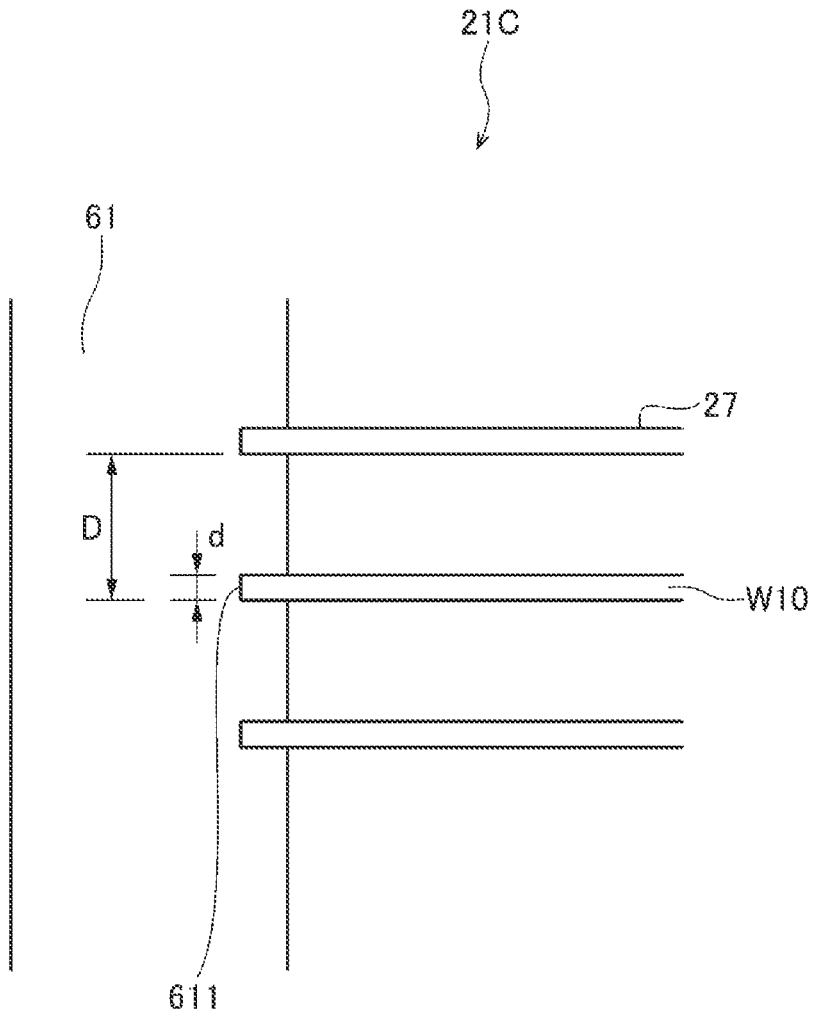
FIG. 22 is a view for explaining a refrigerant distribution structure as a modification.

In a heat exchange core 21C shown in FIG. 22, tubes 27 define the refrigerant passages W10. In this case, the refrigerant receiving tank 61 is configured as an independent tank. The ends of the tubes 27 serve as the inlets 611.

The heat exchanger 10 in the present embodiment includes the refrigerant receiving tank 61 that receives the refrigerant and the refrigerant discharging tank 62 that discharges the refrigerant having heat exchanged, and the refrigerant passages W10 in which heat exchange between the refrigerant and another fluid is performed. The refrigerant passages W10 fluidly connect between the refrigerant receiving tank 61 and the refrigerant discharging tank 62. The refrigerant receiving tank 61 includes the swirl structure (the swirl vane 5, 5A, 5C, 5D, 5E, 5F, 5G, and the swirl member 5B) that generates a swirling component in the flow of the refrigerant in the refrigerant receiving tank 61. The heat exchanger 10 is formed by stacking multiple plates with each other.

The heat exchanger 10 in the present embodiment includes the refrigerant receiving tank 61 that receives the refrigerant and the refrigerant discharging tank 62 that discharges the refrigerant having heat exchanged, and the refrigerant passages W10 in which heat exchange between the refrigerant and another fluid is performed. The refrigerant passages W10 fluidly connect between the refrigerant receiving tank 61 and the refrigerant discharging tank 62. The refrigerant receiving tank 61 includes the swirl structure (the swirl vane 5, 5A, 5C, 5D, 5E, 5F, 5G, and the swirl member 5B) that generates a swirling component in the flow of the refrigerant in the refrigerant receiving tank 61. A width d of each of the inlets of the refrigerant passages W10 and a distance D between adjacent ones of the refrigerant passages are adjusted according to the swirl component generated by the swirl structure.

Since the refrigerant in the refrigerant receiving tank 61 has a swirling component, the refrigerant can be dispersed along a circumferential wall of the refrigerant receiving tank 61. The width d of the inlet of each of the refrigerant passages and the distance D between adjacent ones of the refrigerant passages are adjusted according to the swirling component. Therefore, the refrigerant is inhibited from flowing excessively into the inlet near the swirl structure, and the refrigerant is dispersed in an extending direction of the refrigerant receiving tank 61 and distributed into the inlets of the refrigerant passages.

The heat exchanger 10 in this embodiment satisfies the following formula.

D: Distance between adjacent ones of the refrigerant passages d: Width of an inlet of each of the refrigerant passages θ: Angle of a vane of the swirl structure x: Ratio of an area of the vane to a cross-sectional area of the refrigerant receiving tank $$0<d\cdot x\cdot\cos\theta/D<0.6 \quad \text{(f1)}$$

The heat exchanger 10 in this embodiment preferably satisfies the following formula.

$$0.02<d\cdot x\cdot\cos\theta/D<0.5 \quad \text{(f2)}$$

The heat exchanger 10 in this embodiment is configured by stacking multiple plates with each other. As the plates, a combination of the outer plates 22 and the inner plates 23, a combination of the plates 24*a* and the plates 24*b*, and a combination of the plates 25 and the plates 26 can be used.

In the heat exchanger 10 of the present embodiment, the swirl vane 5, 5A as the swirl structure is formed by one of the plates. By forming the swirl structure integrally with the plate, the number of parts of the heat exchanger 10 can be reduced.

In the heat exchanger 10 of the present embodiment, the swirl structure is provided in the vicinity of the inlet opening of the refrigerant receiving tank 61. The refrigerant flows into the refrigerant receiving tank 61 through the inlet opening. By providing the swirl structure in the vicinity of the inlet opening, the swirling component can be reliably generated in the flow of the refrigerant received by the refrigerant receiving tank 61.

In the present embodiment, the single swirl vane 5 is provided in the vicinity of the inlet opening of the refrigerant receiving tank 61. However, the number of the swirl vanes 5 and a position of the swirl vane 5 are not limited to the above-described embodiments. It is also preferable that the swirl vane 5 is provided inside the refrigerant inflow portion 30. The swirl vane 5 may be provided in the middle of the refrigerant receiving tank 61. The number of the swirl vanes 5 may be multiple.

In the heat exchanger 10 of the present embodiment, the refrigerant flows into the refrigerant tank 61 in an inflow direction. The length of the refrigerant receiving tank 61 along the inflow direction is set to be less than 100 mm.

The swirl vane 5, 5A, 5C, 5D, 5E, 5F, and 5G as the swirl structure may be formed separately from the refrigerant receiving tank 61. By forming the swirl vane 5, 5A, 5C, 5D, 5E, 5F, and 5G separately from the refrigerant receiving tank 61, the degree of freedom in the structure of the swirl vane 5, 5A, 5C, 5D, 5E, 5F, and 5G can be increased. For example, the swirl vane 5, 5A, 5C, 5D, 5E, 5F, and 5G can be formed as a rotor vane that moves slightly instead of a stator vane. For example, the swivel vane 5, 5A, 5C, 5D, 5E, 5F, and 5G may be made of aluminum or another material such as titanium, which is stronger than aluminum.

The present embodiments have been described above with reference to concrete examples. However, the present disclosure is not limited to those specific examples. Those specific examples that are appropriately modified in design by those skilled in the art are also encompassed in the scope of the present disclosure, as far as the modified specific examples have the features of the present disclosure. Each element included in each of the specific examples described above and the arrangement, condition, shape, and the like thereof are not limited to those illustrated, and can be changed as appropriate. The combinations of elements included in each of the above described specific examples can be appropriately modified as long as no technical inconsistency occurs.

What is claimed is:

1. A heat exchanger formed by stacking a plurality of plates with each other, the heat exchanger comprising:

a refrigerant receiving tank configured to receive a refrigerant;

a refrigerant discharging tank configured to discharge the refrigerant that has heat-exchanged; and a plurality of refrigerant passages in which heat exchange between the refrigerant and another fluid is performed, the plurality of refrigerant passages fluidly connecting between the refrigerant receiving tank and the refrigerant discharging tank, wherein the refrigerant receiving tank includes a swirl structure configured to generate a swirling component in a flow of the refrigerant in the refrigerant receiving tank, the swirl structure includes a vane, D is defined as a distance between adjacent ones of the plurality of refrigerant passages, d is defined as a width of an inlet of each of the plurality of refrigerant passages, θ is defined as an angle of the vane of the swirl structure, x is defined as a ratio of an area of the vane to a cross-sectional area of the refrigerant receiving tank, wherein the area of the vane comprises a sum of projected areas of vane shafts and vanes, and the cross-sectional area of the refrigerant receiving tank is determined on a projected horizontal plane which is perpendicular to a stacking direction of the plurality of plates, and $$0<d\cdot x\cdot\cos\theta/D<0.6.$$

2. The heat exchanger according to claim 1, wherein $$0.02<d\cdot x\cdot\cos\theta/D<0.5.$$

3. The heat exchanger according to claim 1, wherein the swirl structure is integrally formed with at least one of the plurality of plates.

4. The heat exchanger according to claim 1, wherein the refrigerant receiving tank defines an inlet opening through which the refrigerant flows into the refrigerant receiving tank, and the swirl structure is disposed in a vicinity of the inlet opening of the refrigerant receiving tank.

5. The heat exchanger according to claim 1, wherein the refrigerant flows into the refrigerant receiving tank in an inflow direction, and a length of the refrigerant receiving tank along the inflow direction is set to be less than 100 mm.

6. The heat exchanger according to claim 1, wherein the swirl structure includes a main shaft and a vane connected to the main shaft, and the vane is tilted at a constant angle relative to the main shaft.

7. The heat exchanger according to claim 1, wherein the swirl structure is separately formed from the refrigerant receiving tank.

* * * * *